United States Patent [19]

Goodman

[11] Patent Number: 5,046,631

[45] Date of Patent: Sep. 10, 1991

[54] PREMIUM DISPENSING CONTAINER

[76] Inventor: Gene W. Goodman, 327 Old Norwalk Rd., New Canaan, Conn. 06840

[21] Appl. No.: 439,550

[22] Filed: Nov. 21, 1989

[51] Int. Cl.[5] ..... B65D 35/00

[52] U.S. Cl. ..... 220/85 R; 215/1 A

[58] Field of Search ..... 220/85 R, 90.2; 215/1 A

[56] References Cited

U.S. PATENT DOCUMENTS

| | | | |
|---|---|---|---|
| 3,656,654 | 4/1972 | Brinkley, III | 215/1 A X |
| 4,356,927 | 11/1982 | Cooper et al. | 215/1 A X |
| 4,877,148 | 10/1989 | Larson et al. | 215/1 A X |
| 4,907,724 | 3/1990 | Wing, Jr. et al. | 215/1 A X |
| 4,923,084 | 5/1990 | Forbes | 215/1 A X |
| 4,930,652 | 6/1990 | Murphy et al. | 215/1 A X |

*Primary Examiner*—Steven M. Pollard

*Attorney, Agent, or Firm*—Parmelee, Bollinger & Bramblett

[57] ABSTRACT

A system is described for dispensing a premium member from a sealed container of fluid such as a beverage. The fluid is dispensed by forming an opening in the container. The container encloses a guide for retaining the premium member adjacent the region of the opening and guiding it through the opening when formed.

29 Claims, 2 Drawing Sheets

PREMIUM DISPENSING CONTAINER

TECHNICAL FIELD

This invention relates to containers. More particularly, it relates to sealed containers of fluids, such as liquids, adapted to present a premium to the consumer when the container is opened. More specifically, there is proposed a container such as a soft drink can, filled with a beverage and containing a premium such as a capsule containing money or other prizes. When the can is opened by the consumer, the capsule is ejected from the opening for removal by the consumer. The beverage also remains accessible for consumption.

BACKGROUND ART

Applicant is not aware of any prior art which is specifically in point. The closest art appears to relate to beverage containers enclosing straws. The closest of these would appear to be U.S. Pat. Nos. 4,537,324 of Wang, 4,690,294 of Jones, and 4,709,829 of Johnson et al. Other straw-containing beverage containers are described in U.S. Pat. Nos. 4,462,503 of Raffaele, et al., 4,582,213 of Park et al., 4,728,001 of Serba, and 4,792,083 of Yassur.

DISCLOSURE OF INVENTION

The present invention provides means for promoting the sale of a product, such as a beverage, contained within a sealed container. This is accomplished by distributing among the many containers available to a consumer, a limited number of containers which appear to be normal but which, in fact, contain some type of premium. One such premium, for example, could be in the form of a floating capsule having within it a rolled bill, scrip, or coupon.

Most beverage containers currently in use are of the tab opening type. In this type of container the raising of a finger tab ruptures the top along a scored line, thereby forming a flap which pivots downwardly into the can. This presents a problem in the case of a floating object such as a capsule in that the capsule must be directed to the opening without being captured by the flap. It must, however, be positioned near the flap at the time of opening the container.

In accordance with the present invention, the container is provided with guide means, preferably secured to the underside of the top and arranged to guide the capsule or other premium toward the container opening. The guide means is also arranged so as not to impede the removal of the liquid.

BRIEF DESCRIPTION OF DRAWINGS

The invention or embodiments thereof is to be described by way of example with reference to the following drawings.

BEST MODE FOR CARRYING OUT THE INVENTION

Figure 1:
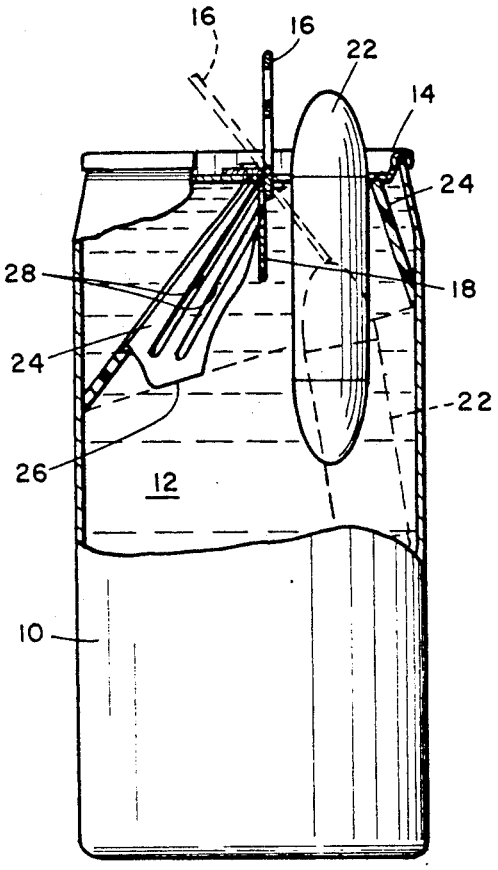
FIG. 1 is an elevational view, partially broken away, of a container in accordance with this invention with the top opened.
Figure 2:
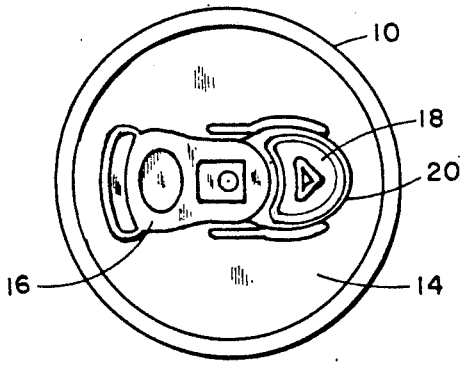
FIG. 2 is a top view of the container of FIG. 1 prior to opening.

FIG. 1 illustrates a conventional beverage container comprising a can 10 which is normally drawn from a single sheet of aluminum. It is then filled with the beverage 12 after which a top 14 is crimpingly sealed to the open end of the can. As will be apparent from FIG. 2, the top 14 is conventional to outward appearances in that it includes a bendable finger tab 16 which can be raised to depress a flap 18 created by the rupture of the top along a scored line 20.

In accordance with the invention, prior to sealing the top 14 to the can 10, a premium such as floating capsule 22 is placed in the filled can. Secured to the underside of the top 14, as by means of an adhesive, is a conical guide 24. The guide 24 may be made, for example, from a lightweight plastic sheet in the form of a truncated cone. The truncated apex of the cone is positioned, as illustrated in FIG. 1, so that it surrounds the opening formed when the flap 18 is depressed by raising finger tab 16. The base 26 of the guide lies close to or against the inner cylindrical surface of the can 10. The guide 24 includes apertures or openings 28 for permitting the beverage 12 to be dispensed after the can is opened.

The can 10 shown in FIG. 1 is a conventional cylinder. However, the "conical" guide 24 could be employed in a container of rectangular or other cross section. Accordingly, "conical" as used in the claims is not limited to a body of revolution but has the more generalized meaning of tapered or funnel-shaped.

It is believed that the operation of the container of FIG. 1 will be apparent from the illustration. When held in the normal upright position for opening, the capsule 22 will be floating within the liquid beverage 12 and retained by the guide 24 directly beneath the closed flap 18. Upon the raising of the finger tab 16, as shown in dotted lines, the descending flap 18 will displace capsule 22 as illustrated. However, as the flap 18 is deflected to the illustrated full vertical position, it will release the capsule 22, permitting it to rise through the guide 24 and the opening formed by the ruptured top 14 to the solid line position shown in FIG. 1. There, it may be readily removed by the consumer. Thereafter the consumer can dispense the beverage in the usual fashion without substantial impediment from the guide 24.

Figure 3:
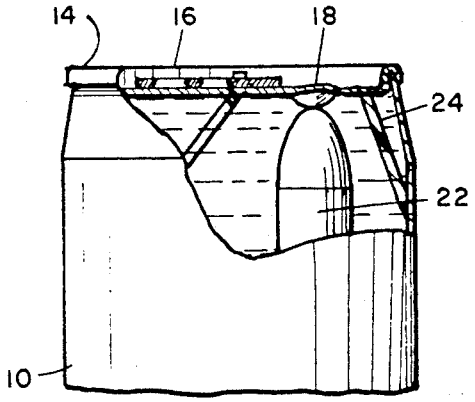
FIG. 3 is a partial view, in partial cross-section, of a modification of the container of FIG. 1 in its closed condition.
Figure 4:
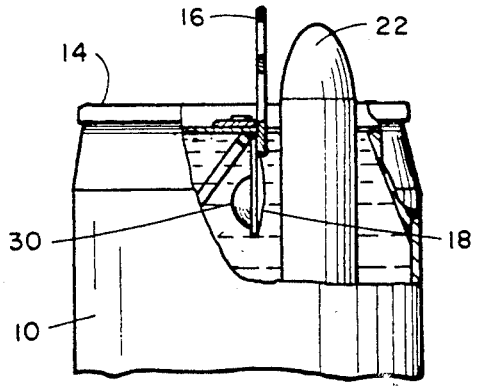
FIG. 4 is a view similar to FIG. 3 showing the container after opening.

Under some circumstances, depending upon the size and shape of the upper end of capsule 22, there might be a tendency for the descending flap 18 to trap the the nose of the capsule 22. In the modification of FIGS. 3 and 4, the flap 18 is modified so that it carries an inwardly projecting dome 30 which serves to cam, or displace, the nose of the capsule 22 to prevent it from being captured between the flap 18 and the sidewall of the guide 24.

Depending upon the material, weight, or other characteristics of the capsule 22, it is conceivable that it might be detected by shaking the container before opening. The construction illustrated in FIGS. 5 and 6 will prevent this and will also permit delivery of a capsule or premium which is not buoyant. It comprises a tubular guide 32 which is suspended from the bottom surface of the top 14 by any suitable means such as a spider 34. The top of the guide 32 is aligned with the flap 18. The guide 32 includes suitable openings 36 to permit passage of the beverage 12. The capsule 23 has a relatively flat base 38 which is supported by the upper end of a coil spring 40. The lower end of coil spring 40 is supported by a base such as a bar 42 mounted across the lower end of the guide 32. In this embodiment, the top 14, spider 34, guide 32, spring 40, and capsule 23 may be assembled as a unit before the top 14 is sealed to the can 10.

The pressure of the spring 40 pushes the capsule 23 against the unopened flap 18 of the top 14 to thereby prevent rattling when the container is shaken. Upon the opening of the container, capsule 23 is forced downwardly by the flap 18 against the pressure of the spring 40. When the flap 18 reaches the position illustrated in FIG. 6, the capsule is ejected through the opening by the spring. It will be noted that the modification of FIGS. 5 and 6 does not depend upon the capsule being buoyant in the liquid 12.

Figure 5:
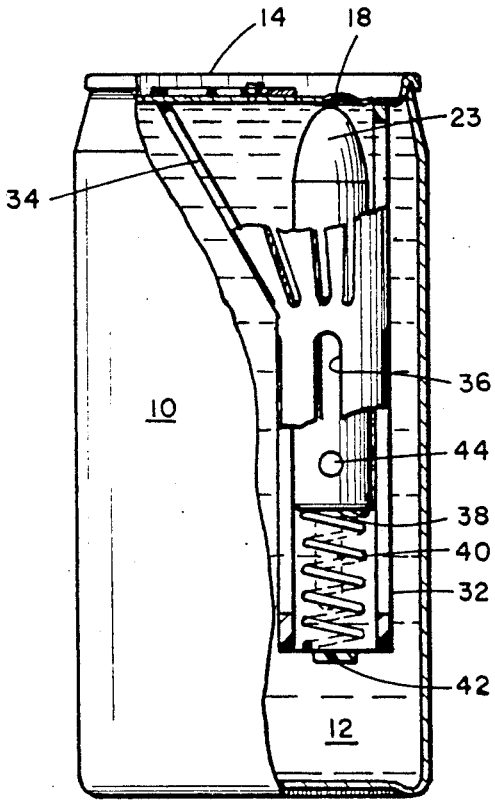
FIG. 5 is an elevational view, partially broken away, of a modification of the invention prior to opening the container.
Figure 6:
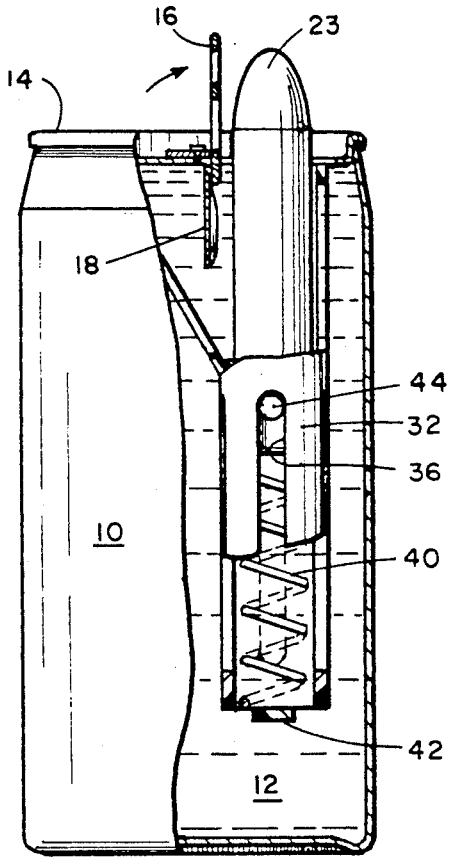
FIG. 6 is a view similar to FIG. 5 shown as it would appear after opening the container.

Under some circumstances, it might be desirable to prevent inadvertent release of a capsule 23 from the container. One means of preventing such release could be a slightly raised bump or detent 44 on the capsule 23 which, as seen in FIGS. 5 and 6, would slide within one of the openings 36. Upon being detained by the top end of the opening, the capsule could be removed by additional force provided by the fingers.

It will be apparent that a number of variations and modifications may be made in this invention without departing from its spirit and scope. For example, although described above in connection with the sale of beverages , it is not so limited. Its concept could be employed in the promotion of any fluid containers including, for example, such items as juices, milk, motor oil, antifreeze, cleaning products, etc. Also, the object delivered through the opening need not be a capsule or its equivalent. It could take the form of a prize object or could, for example, merely be an object carrying some type of indicia such as a number or letter for participating in a game or qualifying for a prize. Many other possibilities will suggest themselves and are encompassed within the term "premium member" as used in the following claims. Accordingly, the foregoing description is to be construed as illustrative only, rather than limiting. This invention is limited only by the scope of the following claims.

What is claimed is:

1. In a sealed container having a body and a top enclosing a fluid therein, said top including an inwardly displaceable flap for producing an opening, the improvement which comprises:

an object within said container and fluid dimensioned to pass through said opening, said object being in alignment with said opening and normally urged toward said top when said container is in an upright position; and means within said body and mounted to said top for retaining said object in alignment with said opening while permitting motion of said object away from said top upon inward displacement by the flap and guiding said object to and through said opening, said inward displacement of said flap causing said object to move away from said top.

2. The improvement of claim 1 wherein said object is urged toward said top as a result of the buoyancy of said object within the fluid.

3. The improvement of claim 1 wherein said flap carries an inwardly protruding dome.

4. The improvement of claim 1 wherein said retaining means comprises a substantially conical barrier having a truncated apex surrounding the displaceable portion of the top.

5. The improvement of claim 4 wherein said fluid is a liquid.

6. The improvement of claim 5 wherein said object is urged toward said top as a result of the buoyancy of said object within the liquid.

7. The improvement of claim 5 additionally including means for preventing inadvertent removal of said object.

8. The improvement of claim 1 wherein said retaining means comprises an elongated guide member securing said object in alignment with the region of said opening.

9. The improvement of claim 8 wherein said guide member comprises a tube at least partially enclosing said object.

10. The improvement of claim 9 wherein said guide member includes a resilient member urging said object toward said top.

11. The improvement of claim 10 wherein said resilient member comprises a spring.

12. The improvement of claim 10 additionally including means for preventing inadvertent removal of said object.

13. A premium-delivering container which comprises:

a body having a sidewall and a bottom;

a liquid substantially filling said body;

a top closing said body and defining a score line partially surrounding an opening area of said top;

means of rupturing said top along said score lines to define an opening in said top;

a premium capsule contained within said liquid having a length substantially less than the maximum internal dimension of said body and urged toward said top when the container is in an upright position; and means carried by the top for retaining said capsule aligned with said opening area and thereafter guiding the capsule to and through the resulting opening upon rupture of the top.

14. The improvement of claim 13 wherein said retaining means comprises a substantially conical barrier having a truncated apex surrounding the opening area of the top.

15. The improvement of claim 14 wherein the capsule is urged toward the top as a result of the buoyancy of the capsule within the liquid.

16. The improvement of claim 13 additionally including means for preventing inadvertent removal of said capsule.

17. The improvement of claim 13 wherein said retaining means comprises an elongated guide member keeping the capsule in alignment with the region of said opening.

18. The improvement of claim 17 wherein the guide member includes means for urging the capsule toward the top.

19. The improvement of claim 18 wherein the urging means is a spring.

20. The improvement of claim 18 additionally including means for preventing inadvertent removal of said capsule.

21. A premium-delivering system which comprises:

a closed container having a body and a top;

a liquid substantially filling said container;

means for forming a liquid dispensing opening in said container;

a premium member enclosed within said container and liquid and urged toward the region of said opening, said premium member having a length substantially less than the maximum internal dimension of said container; and means carried by said top for retaining said premium member adjacent the region of said opening and guiding said member to and through said opening when formed.

22. The system of claim 21 wherein said retaining means comprises a substantially conical barrier having a truncated apex surrounding the opening region.

23. The system of claim 21 wherein the premium member is urged toward the opening region as a result of its buoyancy within the liquid.

24. The system of claim 21 additionally including means for preventing inadvertent removal of said premium member.

25. The system of claim 21 wherein said retaining means comprises an elongated guide member keeping the premium member in alignment with the opening region.

26. The system of claim 25 wherein the guide member includes means for urging the premium member toward the opening region.

27. The system of claim 26 wherein the urging means is a spring.

28. The system of claim 26 additionally including means for preventing inadvertent removal of said premium member.

29. In a sealed container having a body and a top and enclosing a fluid therein, said top including an inwardly displaceable flap for producing an opening, the improvement which comprises:

an object within said container dimensioned to pass through said opening, said object being normally urged toward said top; and means within said body and mounted to said top for retaining said object adjacent, and in alignment with, said displaceable flap while permitting motion of said object away from said top upon displacement by the flap and thereafter guiding said object to and through said opening, said inward displacement of said flap causing said object to move away from said flap.

* * * * *